US007243967B2

(12) United States Patent
Iida et al.

(10) Patent No.: US 7,243,967 B2
(45) Date of Patent: Jul. 17, 2007

(54) TOOL STORAGE COMPARTMENT OF A WORK MACHINE

(75) Inventors: Hirotaka Iida, Tokyo (JP); Tetsu Nakao, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 277 days.

(21) Appl. No.: 10/513,391

(22) PCT Filed: Apr. 22, 2003

(86) PCT No.: PCT/JP03/05093

§ 371 (c)(1),
(2), (4) Date: Jan. 11, 2005

(87) PCT Pub. No.: WO2004/016865

PCT Pub. Date: Feb. 26, 2004

(65) Prior Publication Data

US 2005/0201852 A1 Sep. 15, 2005

(30) Foreign Application Priority Data

Aug. 12, 2002 (JP) ..... 2002-234908

(51) Int. Cl.
*B62D 43/00* (2006.01)

(52) U.S. Cl. ..... 296/37.1; 224/400

(58) Field of Classification Search ..... 296/37.1; 224/400, 401

See application file for complete search history.

(56) References Cited

U.S. PATENT DOCUMENTS 4,179,153 A * 12/1979 Cole, Jr. ..... 296/37.1
4,660,880 A * 4/1987 Bensch ..... 296/37.1

FOREIGN PATENT DOCUMENTS

JP 6-207419 7/1994
JP 7-197488 8/1995

OTHER PUBLICATIONS

International Search Report for PCT/JP03/05093 mailed on Aug. 12, 2003.

* cited by examiner

*Primary Examiner*—Joseph D. Pape
(74) *Attorney, Agent, or Firm*—Darby & Darby

(57) ABSTRACT

A fire wall for defining an engine room and a tank chamber is disposed in a body. The fire wall is provided with a tool storage section. Direct conduction of heat from a hydraulic oil tank to the tool storage section is prevented. Even if hydraulic oil stored in the hydraulic oil tank becomes hot, increase in the temperature of the tool storage section is limited. A sufficient space for storage of tools is ensured.

10 Claims, 5 Drawing Sheets

TOOL STORAGE COMPARTMENT OF A WORK MACHINE

CROSS-REFERENCE TO PRIOR APPLICATION

This is a U.S. national phase application under 35 U.S.C. §371 of International Patent Application No. PCT/JP2003/005093 filed Apr. 22, 2003, and claims the benefit of Japanese Patent Application No. 2002-234908 filed Aug. 12, 2002 both of which are incorporated by reference herein. The International Application was published in Japanese on Feb. 26, 2004 as WO 2004/016865 A1 under PCT Article 21(2).

TECHNICAL FIELD

The present invention relates to a work machine which has a working unit.

BACKGROUND ART

Examples of conventional work machines of this type include a hydraulic excavator comprising a movable undercarriage and an upper structure 1 (shown in FIG. 5), which is rotatably mounted on top of the undercarriage. A revolving unit is provided therebetween. The undercarriage is able to move by means of traveling devices provided at both sides of the undercarriage.

Many of the operational components of conventional working machines maybe housed in the upper structure of FIG. 5. For example, FIG. 5 illustrates a fire wall 6 disposed inside a body 2 located on the upper structure 1. The fire wall 6 divides the interior of the body 2 into an engine room 3 and a tank chamber 5. The engine room 3 houses an engine for driving a hydraulic pump, which is not shown in the drawing. The tank chamber 5 houses a hydraulic oil tank 4 and other relevant components. The hydraulic oil tank 4 stores hydraulic oil to be supplied to and discharged from hydraulic cylinders, which are not shown in the drawing.

A tool storage section 7 for storing tools (not shown) is provided at one side of the hydraulic oil tank 4, between the body 2 and the hydraulic oil tank 4.

A work machine having the structure described above presents a problem in that providing the tool storage section 7 at a side of the hydraulic oil tank 4 makes the tool storage section 7 subject to high temperatures when the hydraulic oil tank 4 becomes hot due to increase in the temperature of the hydraulic oil.

Providing the tool storage section 7 in a relatively narrow space between the body 2 and the side panel of the hydraulic oil tank 4 makes it impossible to ensure sufficient space for housing relatively large tools, such as a hammer.

In order to solve the above problems, an object of the invention is to provide a work machine which is capable of limiting an increase in the temperature of a tool storage section. Another object of the invention is to provide a work machine which ensures sufficient tool storage space.

SUMMARY OF THE INVENTION

A work machine according to the invention has a main body, a working unit mounted on the main body and adapted to be operated by hydraulic actuators, a partition installed in the main body, and a tool storage section that is provided at the partition and serves to store tools. The partition serves to define an engine room, which contains at least an engine, and a tank chamber, which contains at least a hydraulic fluid tank for storing hydraulic fluid to be supplied to and discharged from the hydraulic actuators. With the configuration as above, the tool storage section is provided at the partition which defines the engine room and the tank chamber. Therefore, even when the hydraulic fluid stored in the hydraulic fluid tank becomes hot, the heat of the hydraulic fluid tank is prevented from being directly conducted to the tool storage section so that an increase in the temperature of the tool storage section is limited.

According to another feature of the invention, the tool storage section is provided at the side of the partition that faces the engine room. By thus providing the tool storage section in the engine room, which is relatively spacious, a sufficient space for storage of tools is ensured.

According to yet another feature of the invention, the partition is provided with a cutout portion at a location where the partition defines a part of the lip of the opening of the tool storage section. Forming the cutout portion in the portion of the partition that constitutes a part of the lip of the opening of the tool storage section increases the area of the opening of the tool storage section, thereby facilitating putting tools in and out of the tool storage section. For example, even if a tool stored in the tool storage section is not large, it can be taken out easily from the enlarged opening. Relatively large tools can be visually ascertained from the cutout portion. Providing the cutout portion thus makes the tool storage section more convenient to use.

A work machine according to yet another feature of the invention is provided with a storage section forming plate to be attached to a side planar portion of the partition from the engine room-side so as to form, together with the partition, the aforementioned tool storage section. With the feature as described above, the tool storage section can be formed easily by merely attaching the storage section forming plate to the partition with an increased working efficiency.

DETAILED DESCRIPTION OF PREFERRED EMBODIMENTS OF THE INVENTION

Next, the present invention is explained in detail, referring to an embodiment thereof shown in relevant drawings.

Figure 4:
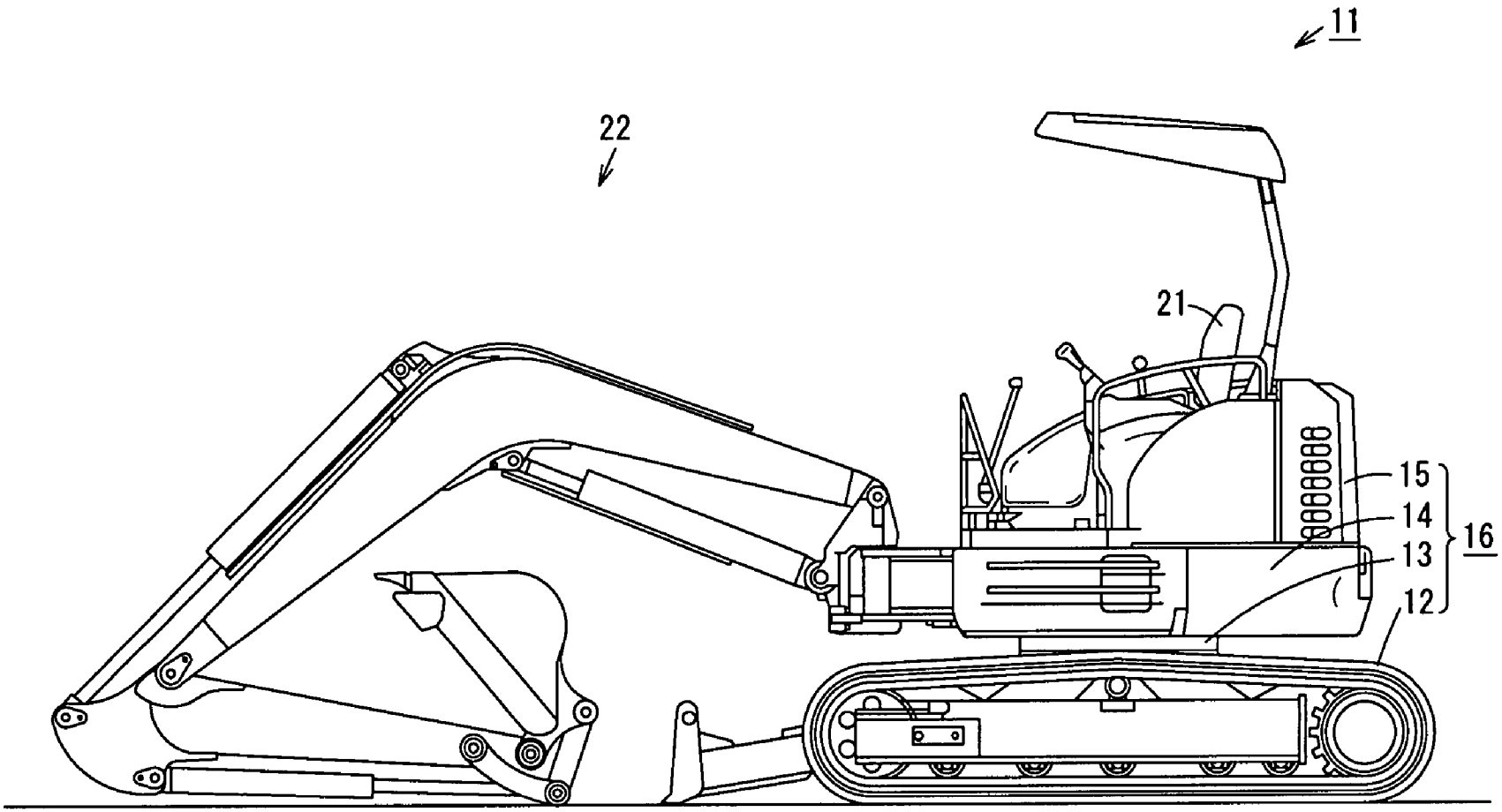
FIG. 4 is a side view of the work machine.
Figure 5:
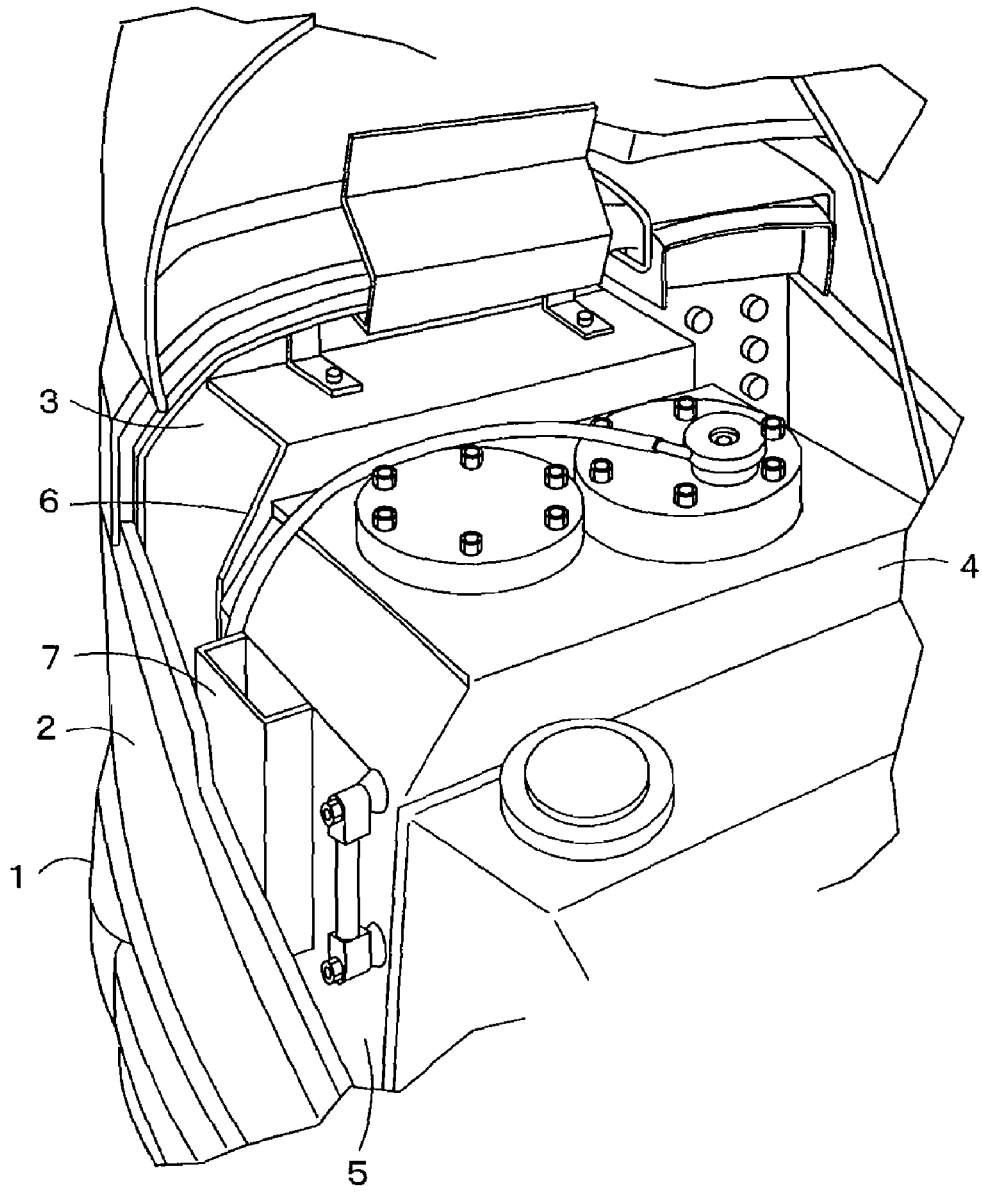
FIG. 5 PRIOR ART
FIG. 5 is a perspective of a part of a conventional work machine.

FIG. 4 shows a hydraulic excavator 11 as a work machine. The hydraulic excavator 11 has an undercarriage 12 and an upper structure 14 rotatably mounted on top of the undercarriage 12, with a revolving unit 13 therebetween. The undercarriage 12 has endless crawler belts to enable traveling. A body 15, which serves as a housing section, is provided on the upper structure 14. The undercarriage 12, the revolving unit 13, the upper structure 14, and the body 15 together form a main body 16.

An operator's cab 21 is provided on the body 15. A working unit 19 for excavation is attached to the front end of the upper structure 14. The upper structure 14 is provided with a front working device 22, which serves as a working unit. The front working device 22 consists of hydraulic actuators, such as boom cylinders for vertically rotating a boom, arm cylinders for rotating an arm, which is secured to the distal end of the boom by a shaft, and a bucket cylinder for rotating a bucket, which is secured to the distal end of the arm by a shaft.

Figure 1:
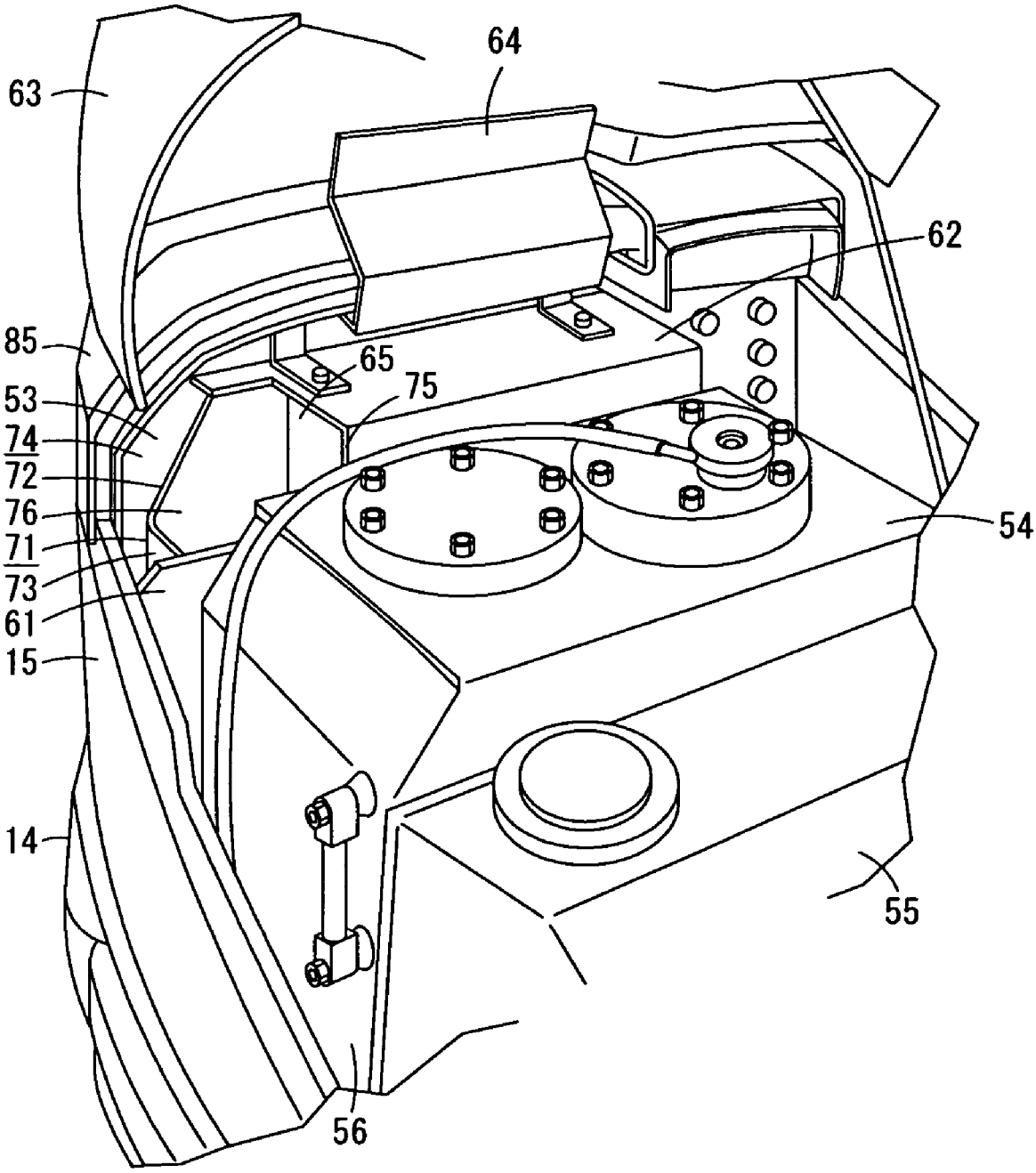
FIG. 1 is a perspective of a part of a work machine according to an embodiment of the present invention.
Figure 3:
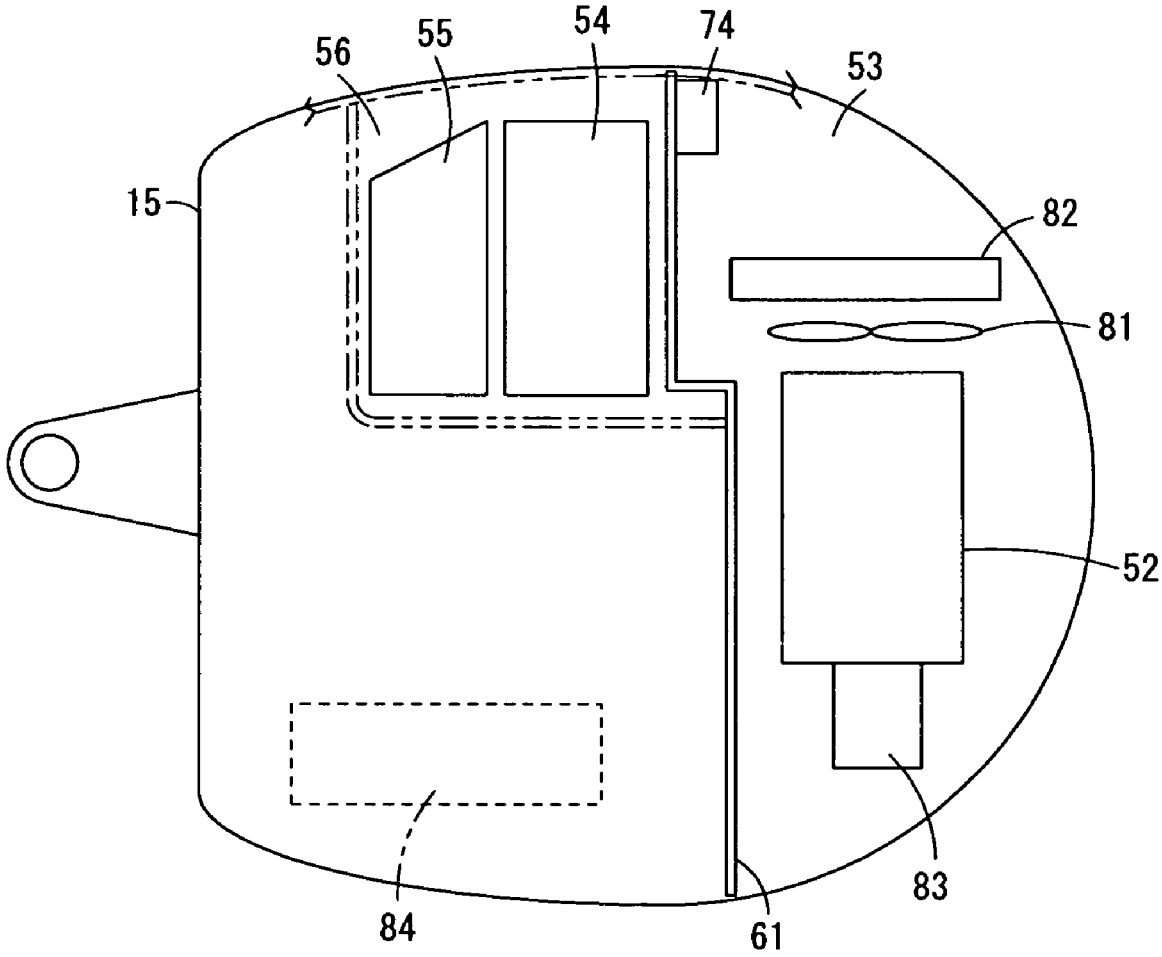
FIG. 3 is a schematic illustration showing the interior of a main body of the work machine.

As shown in FIGS. 1 and 3, a fire wall 51 which is essentially in the shape of a panel and serves as a partition is disposed inside the body 15. The fire wall 51 divides the interior of the body 15, thereby forming an engine room 53 behind the fire wall 51 and a tank chamber 56 in front of the fire wall 51. An engine 52 is housed in the engine room 53. The tank chamber 56 is located to one side of the fire wall 51 and houses a hydraulic oil tank 54, which serves as a hydraulic fluid tank, and a fuel tank 55. Hydraulic oil as hydraulic fluid is stored in the hydraulic oil tank 54. The fire wall 51 is separated from the engine 52 and the hydraulic oil tank 54 by a given distance to limit thermal conduction between the engine room 53 and the tank chamber 56.

Figure 2:
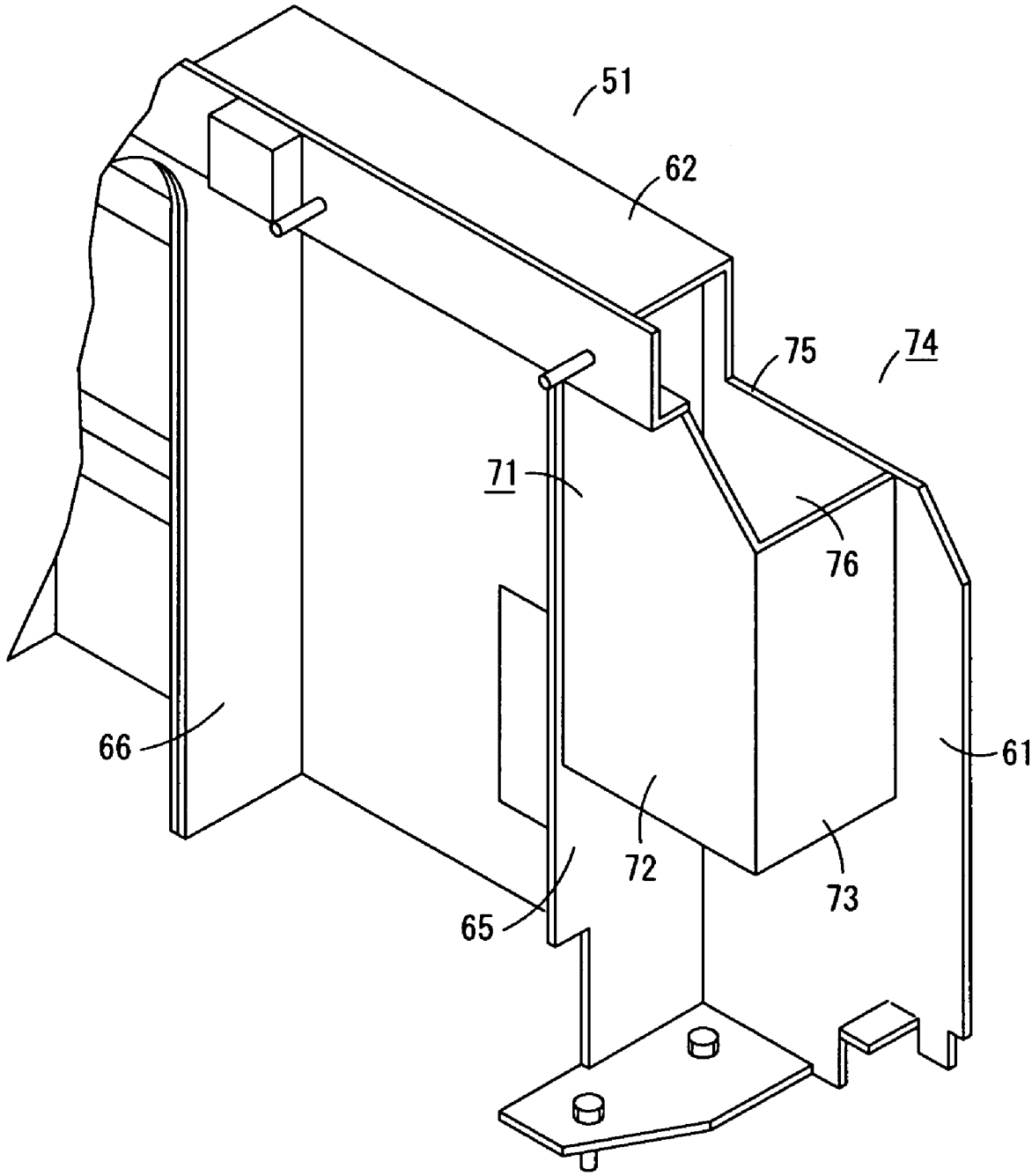
FIG. 2 is a perspective of a partition and a tool storage section of said work machine.

As shown in FIG. 2, the fire wall 51 has a wall 61 which is in the shape of a flat plate extending vertically with respect to the body 15 and slightly taller than the hydraulic oil tank 54. As shown in FIG. 3, the wall 61 extends in the widthwise direction of the body 15 from one of the widthwise sides of the body 15 and, at a side of the operator's cab 21, bent at nearly a right angle towards the rear end of the body 15. The wall 61 is bent again at nearly a right angle so as to extend again in the widthwise direction of the body 15 to the other widthwise side of the body 15.

As shown in FIGS. 1 and 2, a mounting plate portion 62 is formed by bending a part of the upper portion of the wall 61 at nearly a right angle so that the bent portion extends horizontally towards the engine room 53. As shown in FIG. 1, a front cover 63 for closing off the upper portion of the tank chamber 56 is attached to the mounting plate portion 62 with a hinge 64 so that the front cover 63 can be opened or closed vertically.

A plurality of flat, rectangular reinforcing plates, for example two reinforcing plates 65,66, for reinforcing the wall 61 are provided behind the wall 61, in other words at the side facing the engine room 53, underneath the mounting plate portion 62. The reinforcing plates 65, 66 are spaced apart in the widthwise direction of the wall 61. Each reinforcing plate 65, 66 extends up the entire height of the wall 61 and is welded to the wall 61 in such a state as to projects from the surface of the wall 61 at nearly a right angle thereto.

A storage section forming plate 71 having a height less than the height of the wall 61 is attached to the upper part of the side face of the reinforcing plate 65. The storage section forming plate 71 is integrally formed of side plate portions 72, 73 and a bottom plate portion (not shown) at the bottom of the side plate portions 72, 73. The side plate portion 72 is a flat plate disposed at nearly a right angle and welded to the reinforcing plate 65. The side plate portion 73 is formed as an integral body with the side plate portion 72 by bending the non-attached portion of the side plate portion 72 or welding a plate to the end of the side plate portion 72 not attached to the reinforcing plate 65. The non-attached end of the side plate portion 73 is welded to the wall 61 at nearly a right angle thereto. The bottom plate portion is formed as an integral body with the side plate portions 72, 73 by bending the lower end portion of either one of or both the side plate portions 72, 73 or welding a plate to the side plate portions 72, 73. The bottom plate portion is welded to the wall 61 and the reinforcing plate 65.

The side plate portion 72 is at a right angle to the side plate portion 73 and the bottom plate portion; the side plate portion 73 is at a right angle to the side plate portion 72 and the bottom plate portion; and the bottom plate portion is at a right angle to the side plate portions 72, 73 so that these side plate portions 72, 73 and the bottom plate portion together form the storage section forming plate 71 which has a bottom and an L-shaped cross section.

A part of the upper end of the side plate portion 72 is slanted downward towards the upper end of the side plate portion 73.

As a result, a part of the wall 61, the reinforcing plate 65 and the storage section forming plate 71 together define a tool storage section 74 at the side of the wall 61 facing the engine room 53, towards one of the widthwise sides of the wall 61. Tools which are not shown in the drawings are stored vertically in the tool storage section 74.

An essentially rectangular cutout portion 75 is formed at the lip of the opening of the tool storage section 74 of the fire wall 51 by cutting away a part of the upper end portion of the wall 61, at a location where the wall 61 faces the hydraulic oil tank 54. The cutout portion 75 forms a large opening 76 for the tool storage section. When the front cover 63 is opened, the opening 76 is exposed to the outside of the body 15 through the open top of the tank chamber 56. By closing the front cover 63, the opening 76 is closed off.

The lower end of the cutout portion 75 is approximately flush with the top of the side plate portion 73. The height of the storage section forming plate 71 with respect to the wall 61 is such that the ends of some of the tools stored in the tool storage section 74 are exposed from the opening 76 to the outside of the tool storage section 74 and are also kept clear of the inner surface of the front cover 63 when the front cover 63 is closed.

As shown in FIG. 3, the engine 52 is horizontally installed in the engine room 53 in such a state that the lengthwise direction of the engine 52 is parallel to the widthwise direction of the body 15. A cooling fan 81 is rotatably attached to one of the lengthwise ends of the engine 52. A cooling device 82 comprising a radiator and an oil cooler is disposed at the end of the cooling fan 81 that faces away from the engine 52. The cooling device 82 is located near the tool storage section 74.

A hydraulic pump 83 is connected to a crankshaft (not shown) of the engine 52 so that driving the engine 52 rotates the crankshaft, thereby driving the hydraulic pump 83.

The hydraulic oil tank 54 is housed in the tank chamber 56, towards one of the widthwise sides of the body 15 and near the fire wall 51. The fuel tank 55 contains fuel for driving the engine 52 and is installed in the tank chamber 56, in front of the hydraulic oil tank 54.

A control valve 84 serving as a control device is provided inside the upper structure 14, in front of the fire wall 51 to the side opposite the side where the fuel tank 55 and the hydraulic oil tank 54 are located, in other words below the operator's cab 21. The control valve 84 connects the hydraulic pump 83 through hoses (not shown) to such components as traveling motors, a turntable motor and working unit cylinders, i.e. the aforementioned boom cylinders, arm cylinders and bucket cylinder, none of which is shown in the drawings.

By controlling hydraulic oil discharged from the hydraulic pump 83, the control valve drives these motors and feed pressurized hydraulic oil to the hydraulic actuators, such as the boom cylinders, the arm cylinders and the bucket cylinder, thereby rotating the boom, the arm and the bucket of the front working device 22.

An engine hood 85 for closing off the top of the engine room 53 is provided above and behind the fire wall 51 in such a manner that the engine hood 85 can be opened or closed vertically. By opening the engine hood 85 upward, the engine room 53 is exposed to the outside of the main body 16.

Next, the functions and effects of the present embodiment are explained hereunder.

The tool storage section 74 is provided at the fire wall 51, which divides the interior of the body 15 to form the engine room 53 and the tank chamber 56. Therefore, even when the hydraulic oil stored in the hydraulic oil tank 54 becomes hot, the heat of the hydraulic oil tank 54 is prevented from being directly conducted to the tool storage section 74. As an increase in the temperature of the tool storage section 74 is limited, tools stored in the tool storage section 74 are protected from excessive heat.

As shown in FIG. 3, the tool storage section 74 is provided at the side of the fire wall 51 facing the engine room 53, which is relatively spacious. Therefore, a sufficient space for storage of tools is ensured. Furthermore, as the tool storage section 74 is provided inside the engine room 53, in the portion in which the cooling device 82 is located, an excessive increase in the temperature of the tool storage section 74 is more effectively prevented.

To use a tool, the front cover 63 is opened so that the tool can be taken out of the opening 76 of the tool storage section 74, which faces the outside of the body 15. When putting away a tool, the opening 76 of the tool storage section 74 can be closed off by closing the front cover 63 after the tool is placed in the tool storage section 74. By thus eliminating the necessity of providing a lid or the like as a separate body for opening or closing the opening 76 of the tool storage section 74, the embodiment described above simplifies the process of forming the tool storage section 74 and reduces the number of parts, thereby reducing production costs.

Forming the cutout portion 75 in the portion of the fire wall 51 that constitutes a part of the lip of the opening 76 of the tool storage section 74 increases the area of the opening 76 of the tool storage section 74, thereby facilitating the removal and return of the tools. For example, even if a tool housed in the tool storage section 74 is not large, it can be taken out easily from the enlarged opening 76. Relatively large tools can be visually ascertained from the cutout portion 75. Providing the cutout portion 75 thus makes the tool storage section 74 more convenient to use.

The tool storage section 74 is formed by welding the storage section forming plate 71 to the engine room-side of the wall 61 of the fire wall 51, i.e. the side that faces the engine room 53. To be more specific, the storage section forming plate 71 is welded to the portion where the wall 61 and the reinforcing plate 65 together form an L-like shape when viewed from the top. In other words, the tool storage section 74 can be formed easily by merely attaching the storage section forming plate 71 to the wall 61 and the reinforcing plate 65. As the embodiment having this feature is capable of increasing working efficiency when forming the tool storage section 74 and also reducing the number of members that have to be processed to form the tool storage section 74, the embodiment improves the manufacturability of the tool storage section 74.

Making the top of the side plate portion 73 and the lower end of the cutout portion 75 virtually flush with each other enlarges the opening 76 and enables the tool storage section 74 to store relatively large tools. Forming a part of the upper end of the side plate portion 72 so as to slant downward towards the upper end of the side plate portion 73 permits the upper ends of tools stored in the tool storage section 74 to lean against the slanted portion, thereby enabling the more effective use of the space of the engine room 53.

As another embodiment of the invention, the tool storage section 74 may be formed integrally with the fire wall 51 by deforming the wall 61 or other portions.

INDUSTRIAL APPLICABILITY

A work machine according to the invention may be a hydraulic excavator or any other work machine equipped with a tool storage section for storage of tools.

The invention claimed is:

1. A work machine comprising:

a main body, a working unit mounted on the main body and adapted to be operated by hydraulic actuators, a partition installed in the main body so as to define:

an engine room, which contains at least an engine, and a tank chamber, which contains at least a hydraulic fluid tank for storing hydraulic fluid to be supplied to and discharged from said hydraulic actuators, and a tool storage section that is provided at said partition and serves to store tools.

2. A work machine as claimed in claim 1, wherein:

the tool storage section is provided at the side of the partition that faces the engine room.

3. A work machine as claimed in claim 2, wherein:

the partition is provided with a cutout portion at a location where the partition defines a part of the lip of the opening of the tool storage section.

4. A work machine as claimed in claim 2, wherein:

the work machine is provided with a storage section forming plate to be attached to a side planar portion of the partition from the engine room-side so as to form, together with the partition, said tool storage section.

5. A work machine as claimed in 3, wherein:

the work machine is provided with a storage section forming plate to be attached to a side planar portion of the partition from the engine room-side so as to form, together with the partition, said tool storage section.

6. A tool storage section for a work machine including a main body, a working unit mounted on the main body and adapted to be operated by hydraulic actuators, a partition installed in the main body so as to define:

an engine room, which contains at least an engine, and a tank chamber, which contains at least a hydraulic fluid tank for storing hydraulic fluid to be supplied to and discharged from said hydraulic actuators, and a reinforceing plate disposed on said partition; comprising:

a first side plate portion disposed on said reinforcing plate;

a second side plate portion disposed on said portion and attached to said first side plate; and a bottom plate disposal on said first side plate and said second side plate; and wherein said first side plate, said second side plate and said bottom plate forming an interior volume therein.

7. The tool storage section of claim 6, wherein a top end of said first side plate is angled downward toward said second side plate.

8. The tool storage section of claim 6, further comprising:

a cutout portion forming an opening to said interior volume.

9. The tool storage section of claim 6, wherein a front cover attached to a mounting plate portion of the partition closes said tool storage section.

10. The tool storage section of claim 6, wherein said tool storage section is disposed on a side of the partition facing the engine room.

* * * * *